US006109498A

United States Patent [19]

Aschenbeck

[11] Patent Number: 6,109,498

[45] Date of Patent: Aug. 29, 2000

[54] SHOCK ABSORBER ASSEMBLY FOR REDUCING BREAKS IN AN ASPHALT-COATED SHEET

[75] Inventor: David Aschenbeck, Newark, Ohio

[73] Assignee: Owens Corning Fiberglas Technology, Inc., Summit, Ill.

[21] Appl. No.: 09/223,199

[22] Filed: Dec. 30, 1998

[51] Int. Cl.[7] ..... B65H 20/30; G11B 15/56

[52] U.S. Cl. ..... 226/118.2

[58] Field of Search ..... 226/118.1, 118.2, 226/118.3; 242/419.1, 417.2

[56] References Cited

U.S. PATENT DOCUMENTS

| | | | |
|---|---|---|---|
| 1,499,307 | 6/1924 | Parkes | 242/417.2 X |
| 1,876,761 | 9/1932 | Rosener | 226/118.1 X |
| 4,173,409 | 11/1979 | Genthe et al. | 226/118.1 X |
| 4,560,099 | 12/1985 | Arioli et al. | 226/118.2 X |
| 5,494,205 | 2/1996 | Nielsen et al. | 226/118.1 X |

*Primary Examiner*—Donald P. Walsh
*Assistant Examiner*—Collin A. Webb
*Attorney, Agent, or Firm*—Inger H. Eckert; James J. Dottavio

[57] ABSTRACT

A shock absorber assembly for a finish looper that reduces breaks of a asphalt-coated sheet. The finish looper includes a plurality of looper rolls forming a plurality of free hanging loops of the asphalt-coated sheet. The shocker absorber assembly is mounted on a frame structure capable of relative movement with respect to the looper rolls. The shock absorber assembly includes a plurality of rolls including an indexing roll, a guide roll, and a shock roll positioned between the indexing roll and the guide roll. Just prior to the last free hanging loop being completely payed out, the shock roll is in an up position and the indexing roll is in a down position. When the asphalt-coated sheet is further payed out, the asphalt-coated sheet engages the indexing roll and causes it to pivot from the down position to an up position. The weight and acceleration of the adjacent, upstream free hanging loop causes the shock roll to move from the up position to the down position. The movement of the indexing roll and shock rolls shortens the path length of the asphalt-coated sheet through the shock absorber assembly and reduces the acceleration rate of the sheet in the next loop, thereby reducing breakage of the asphalt-coated sheet when it is payed out from the last free hanging loop. A method of reducing breaks in the asphalt-coated sheet is also described.

20 Claims, 3 Drawing Sheets

SHOCK ABSORBER ASSEMBLY FOR REDUCING BREAKS IN AN ASPHALT-COATED SHEET

TECHNICAL FIELD AND INDUSTRIAL APPLICABILITY OF THE INVENTION

This invention relates to an asphalt-coated sheet apparatus, and in particular to a shock absorber assembly that reduces breaks in an asphalt-coated sheet due to jerking of the sheet during run out of the asphalt-coated sheet from the finish looper.

BACKGROUND OF THE INVENTION

Asphalt-based roofing materials, such as roofing shingles, roll roofing and commercial roofing, are manufactured from a single sheet of asphalt-coated material. During the manufacturing process, the asphalt-coated material is temporarily contained in a finish looper before cutting the material and packaging for delivery. Typically, the finish looper includes a plurality of looper rolls for forming a plurality of free hanging loops of the asphalt-coated material. The looper rolls travel in a downstream direction, toward shingle cutting and packaging stations, and the continuous shingle material is withdrawn from the loops of the looper as needed for operation of the shingle cutter and packager. The finish looper enables the continuous shingle material to accumulate for a short period of time in the event of a temporary stopping or slowing down of the shingle cutter and/or shingle cutter. Also, the finish looper enables a continuous supply of continuous shingle material to be supplied for a short period when the asphalt coater or other apparatus associated with the forming of the continuous shingle material is temporary slowed or stopped upstream of the finish looper.

During normal operating conditions, the asphalt-coated material is payed out of the finish looper by a pulling or withdrawing of the material from each of the loops of the looper, one at a time. During normal operation the loops are pulled out at a rate as fast as every few seconds. As each loop is pulled out of the looper, the last few feet of the material becomes suddenly taut as the next or subsequent loop is pulled to sheet payout speed. The sudden tautness or jerking causes the shingle material to experience a strong spike of tensile stress. This tendency for the shingle material to snap taut is exacerbated by the tendency of the next or subsequent loop to actually pull back on the previous loop during the last stages of the pulling out of each loop, thereby increasing the speed differential of the material relative to the sheet payout speed. This jerking of the asphalt-coated material may cause a break in the asphalt-coated material, which in turn, causes significant delays in the manufacturing operation. Accordingly, there is a need for an apparatus for use with a finish looper that reduces breaks in the asphalt-coated sheet during manufacturing.

SUMMARY OF THE INVENTION

The above objects as well as other objects not specifically enumerated are achieved by a shock absorber assembly for a finish looper having a plurality of looper rolls forming a plurality of free hanging loops of an asphalt-coated sheet. The shock absorber assembly comprises a shock roll for supporting a last free hanging loop of the plurality of free hanging loops. The shock roll is capable of being positioned relative to an adjacent, upstream looper roll and its associated free hanging loop when the last free hanging loop is payed out.

In another embodiment of the invention, there is provided a shock absorber assembly for a finish looper having a plurality of looper rolls for forming a plurality of free hanging loops of the asphalt-coated sheet. The shock absorber assembly comprises an indexing roll having a brake pad positioned adjacent a last free hanging loop of the plurality of free hanging loops. The indexing roll prevents the free hanging loop from traveling in a downstream direction as the asphalt-coated sheet is being payed out from the last free hanging loop.

According to this invention, there is also provided a shock absorber assembly for a finish looper having a plurality of looper rolls for forming a plurality of free hanging loops of the asphalt-coated sheet. The shock absorber assembly comprises an indexing roll having a brake pad positioned adjacent a looper roll forming a last free hanging loop of the plurality of free hanging loops. The indexing roll provides an indexing function for the shock absorber assembly by positioning the shock absorber assembly relative to an adjacent, upstream looper roll and its associated free hanging loop when the last free hanging loop is payed out.

According to this invention, there is also provided a method of reducing breaks in a asphalt-coated sheet in a finish looper having a plurality of looper rolls for forming a plurality of free hanging loops of the asphalt-coated sheet. The method includes the step of providing a shock absorber assembly having a shock roll for supporting or temporarily suspending a last free hanging loop of the plurality of free hanging loops, whereby the shock roll is capable of being positioned relative to an adjacent, upstream looper roll and its associated free hanging loop when the last free hanging loop is payed out.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
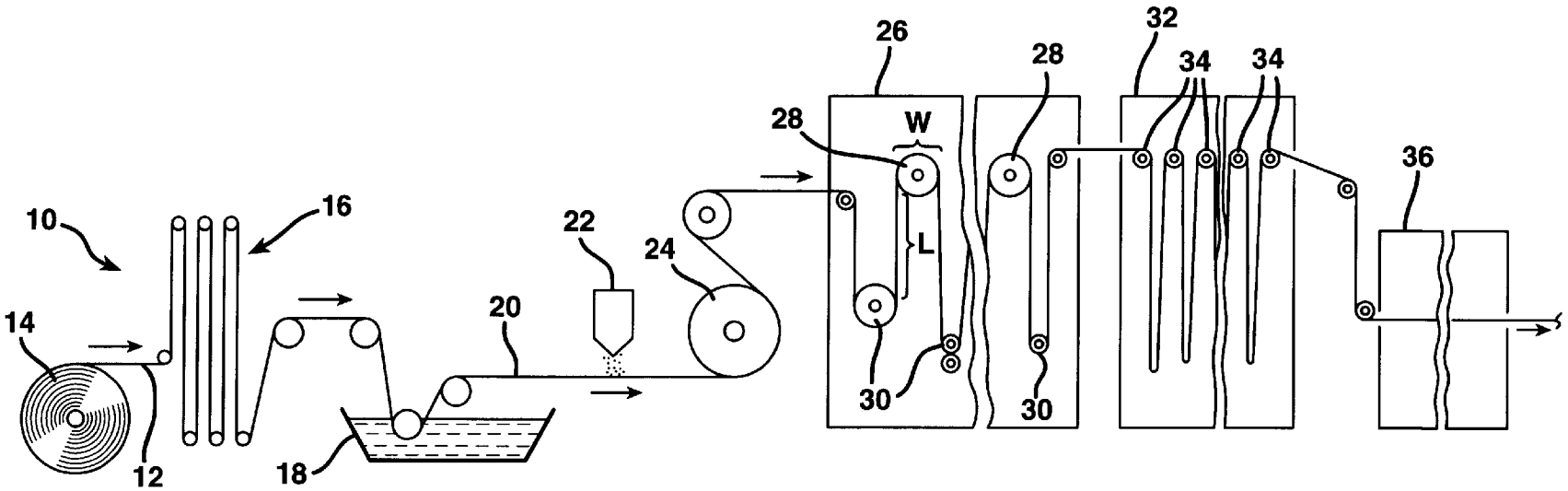
FIG. 1 is a schematic cross-sectional view in elevation of an asphalt shingle manufacturing apparatus including a finish looper according to a preferred embodiment of the invention.

Referring now to the drawings, there is shown in FIG. 1, an apparatus 10 for manufacturing an asphalt-based roofing material according to the invention. The illustrated manufacturing process involves passing a continuous sheet 12 in a machine direction (indicated by the arrows) through a series of manufacturing operations. The sheet usually moves at a speed of at least about 200 feet/minute (61 meters/minute), and typically at a speed within the range of between about 450 feet/minute (137 meters/minute) and about 800 feet/minute (244 meters/minute).

In a first step of the illustrated manufacturing process, a continuous sheet of substrate 12 is payed out from a roll 14. The substrate can be any type known for use in reinforcing asphalt-based roofing materials, such as a web, scrim or felt of fibrous materials such as mineral fibers, cellulose fibers, rag fibers, mixtures of mineral and synthetic fibers, or the like. Combinations of materials can also be used in the substrate. Preferably, the substrate is a nonwoven web or a wet process mat of glass fibers.

The sheet of substrate is passed from the roll through an accumulator 16. The accumulator allows time for splicing one roll of substrate to another, during which time substrate within the accumulator 16 is fed to the manufacturing process so that the splicing does not interrupt manufacturing.

Next, the sheet 12 is passed through a coater 18 where an asphalt coating is applied to the sheet. The asphalt coating can be applied in any suitable manner. In the illustrated embodiment, the sheet 12 is submerged in a supply of hot, melted asphalt coating to completely cover the sheet 12 with the tacky coating. However, in other embodiments, the asphalt coating could be sprayed on, rolled on, or applied to the sheet by other means. When an organic felt is used as the substrate, it may be desirable to first saturate the felt with a saturate asphalt, and then coat the upper and lower surfaces of the felt with an asphalt coating containing a filler.

The term "asphalt coating" means any type of bituminous material suitable for use on a roofing material, such as asphalt, tar, pitch, or mixtures thereof. The asphalt can be either a manufactured asphalt produced by refining petroleum or a naturally occurring asphalt. The asphalt coating can include various additives and/or modifiers, such as inorganic fillers or mineral stabilizers, and organic materials such as polymers. Preferably, the asphalt coating comprises asphalt and inorganic fillers or mineral stabilizers.

The asphalt-coated sheet 20 is then passed beneath a granule hopper or dispenser 22 for the application of granules to the upper surface of the asphalt coating. The granule dispenser 22 may discharge granules to achieve any desired appearance. For example, the granule dispenser may discharge granules having different colors at different areas of the asphalt-coated sheet 20 to achieve a variegated shingle appearance. After deposit of the granules, the sheet is then turned around a slate drum 24 to press the granules into the asphalt coating and to temporarily invert the sheet.

Subsequently, the asphalt-coated sheet 20 is passed through a cooling section 26 where it is cooled and dried. Within the cooling section 26, the asphalt-coated sheet 20 can be directed by upper pulleys 28 and lower pulleys 30 into a plurality of loops having lengths, L, and widths, W. Preferably, the lengths are generally vertical.

After passing through the cooling section 26, the cooled and dried asphalt-coated sheet 20 can be directed into a temporary storage or finish looper 32 which accumulates the asphalt-coated sheet 20 on a plurality of looper rolls 34. Typically, the finish looper 32 will contain about two-hundred forty looper rolls 34 separated about twelve inches apart, each looper roller 34 having a diameter of about four inches and a length of about four feet. It should be noted that the looper rolls 34 are round, but are not freely rotatable. The length of asphalt-coated sheet 20 forming a loop is approximately twenty-five feet. The asphalt-coated sheet 20 is then delivered to a shingle cutter 36 at a speed within the range of between about 450 feet/minute (137 meters/minute) and about 800 feet/minute (244 meters/minute, and typically about 600 feet/minute (183 meters/minute). Downstream from the shingle cutter is a shingle packaging station, not shown.

Figure 2:
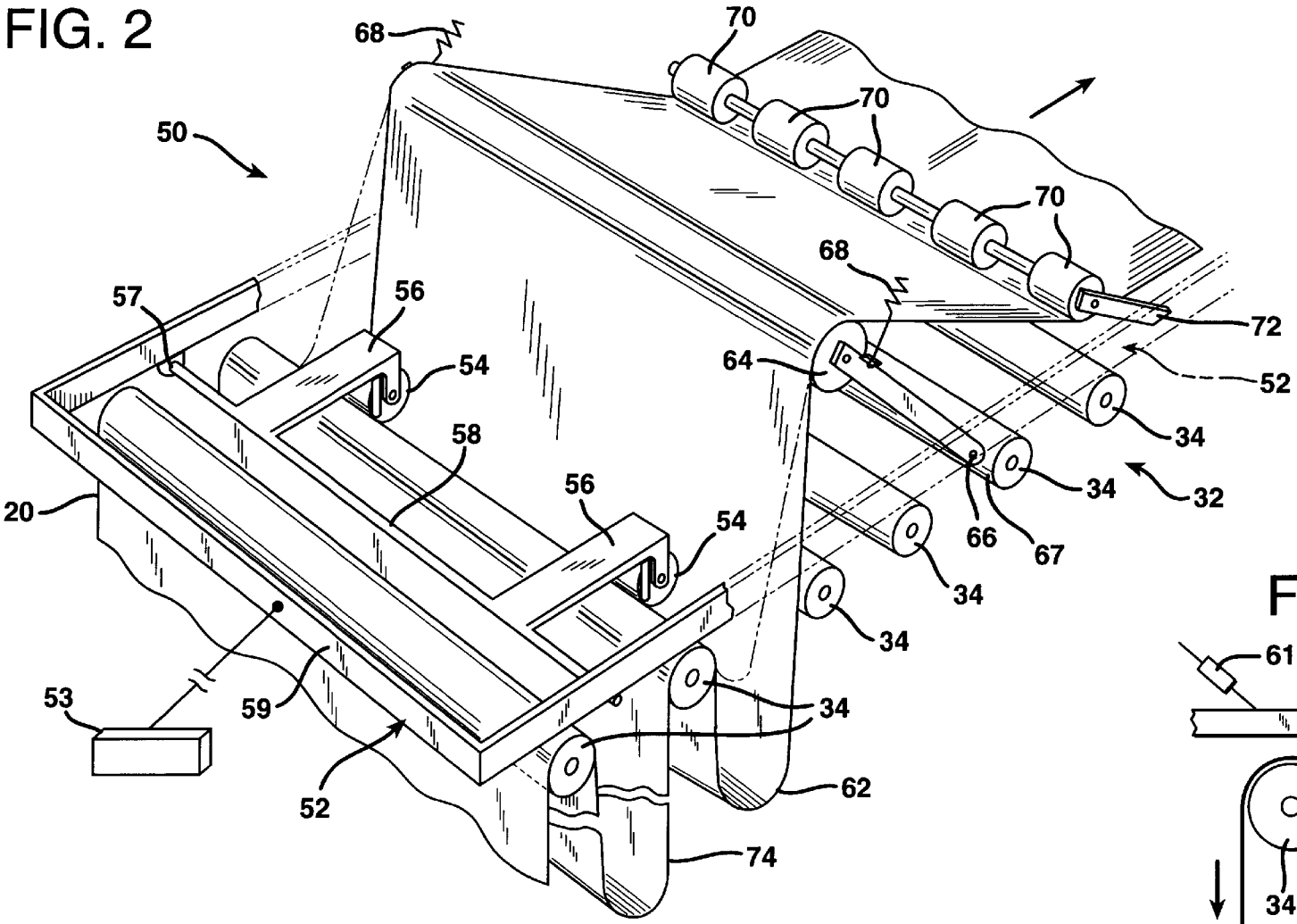
FIG. 2 is a schematic perspective view of a portion of the finish looper and the shock absorber assembly of the invention prior to and including when the asphalt-coated sheet engages the indexing roll of the shock absorber assembly.

FIG. 2 illustrates a portion of the finish looper apparatus, including a shock absorber assembly, shown generally at 50, that reduces breaks in the asphalt-coated sheet 20 in the finish looper 32 according to the preferred embodiment of the invention. The shock absorber assembly 50 includes a frame structure 52 capable of traversing upstream and downstream of the rollers 34 of the finish looper 32. This can be accomplished, for example, by mounting the frame structure 52 to wheels that can ride on a track (not shown) located above the looper rolls 34. The frame structure 52 is shown partially in phantom for clarity. A counterweight 53 may be connected to the upstream portion 59 of the frame structure 52 so as to exert a force on the frame structure 52 in the upstream direction. The purpose of this upstream force will be discussed below.

Figure 4:
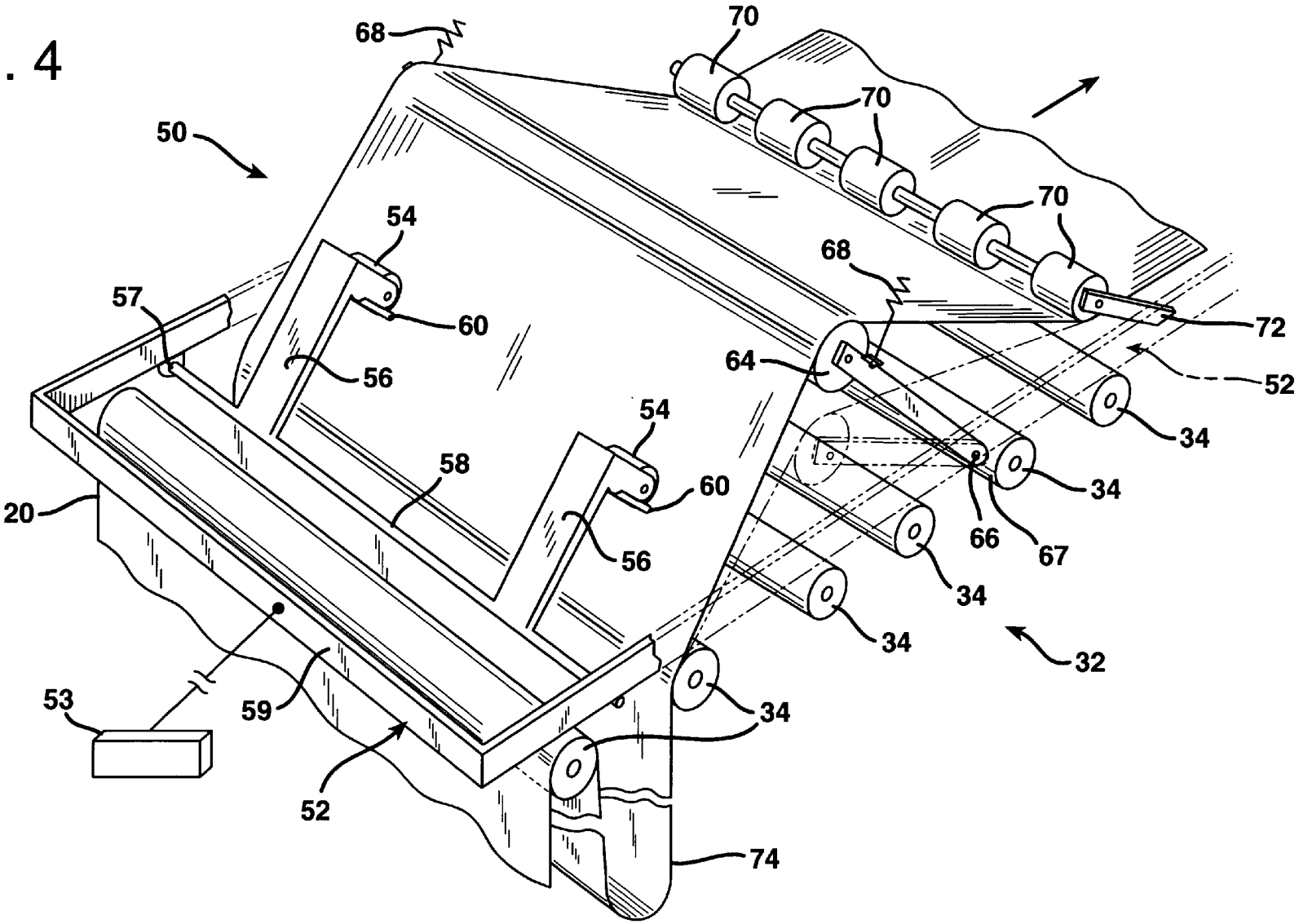
FIG. 4 is another side perspective view of the finish looper similar to FIG. 2, but after the asphalt-coated sheet engages the indexing roll of the shock absorber assembly.

The upstream end of the frame structure 52 includes one or more, and preferably at least two brake/indexing assemblies, shown generally at 55. Each brake/indexing assembly 55 includes an indexing wheel or roll 54 mounted on a pivot arm 56. The pivot arms 56 are preferably rigidly attached to a rod or pivot axis 58, which can rotate in place to enable the pivot arms and indexing rolls to rotate in unison about the pivot axis 58. It should be understood that the invention is not limited to the number of indexing rolls 54, and that the invention can be practiced with any desirable number of rolls. In the preferred embodiment, the indexing rolls 54 are approximately four inches in diameter, and have a surface with a high coefficient of friction. The pivot rod or axis 58 extends between opposite sides of the frame structure 52, and can be mounted for rotation in pivot brackets 57 attached to the frame structure 52. In addition, a damping device 61, for example, a hydraulic cylinder and the like, may be attached to each pivot arm 56 in order to allow the pivot arm 56 to return slowly from the up position, as shown in FIG. 4, to a down position, as shown in FIG. 2.

A brake pad 60 is preferably mounted to each pivot arm 56 in any suitable manner, such as, with a threaded fastener (not shown). Preferably, the brake pad 60 is made of material having a high coefficient of friction. During normal operation, the asphalt-coated sheet 20 travels through the finish looper 32 as indicated by the arrows in FIGS. 2 and 4. However, the upstream portion of the loop of the asphalt-coated sheet 20 may have a tendency to travel in a reverse direction, or upstream, during the paying out of the last few feet of each loop. The purpose of the brake pad 60 is to frictionally engage the asphalt-coated sheet 20 of the last free hanging loop 62 and press it against the looper roll 34 to prevent the upstream portion of the last loop from undesirably traveling around the upstream looper roll 34 in the reverse or upstream direction, as indicated by the direction of the arrow in FIG. 3. Preferably, the brake pad 60 is mounted offset from the indexing roll 54 on the pivot arm 56 (to the left as viewed in FIG. 3) such that during the paying out of the last loop 62 only the brake pad 60 presses the upstream portion of the asphalt-coated sheet 20 against the looper roll 34. The indexing roll 54 does not press against or contact the asphalt-coated sheet until the last loop is just about payed out and the bottom of the loop reaches the indexing roll.

The shock absorber assembly 50 also includes a shock roll 64 preferably positioned in a middle portion of the shock absorber assembly 50. In the preferred embodiment, the shock roll 64 is a continuous roll made of a lightweight material and has a diameter of approximately six inches. It is important that the shock roll 64 be made of lightweight material in order for the shock roll 64 to have as little mass as possible, for a purpose described below. Each end of the shock roll 64 is rotatably connected to a pivot arm 66 (only one of which is shown in FIGS. 2 and 4). The pivot arms 66 are, in turn, pivotally connected to the frame structure 52 with brackets 67. While the frame structure 52 remains substantially stationary, the shock roll 64 is positioned adjacent the looper roll 34 associated with the last free hanging loop 62 such that the downstream portion of the last loop hangs from or is supported from the shock roll 64.

The shock absorber assembly 50 also includes one or more springs 68 attached to each pivot arm 66. The springs 68 provide a biasing force in the upward direction to counteract the downward force of approximately one-half of the weight of the last free hanging loop 62 (approximately 40 lbs.), i.e., the downstream portion of the last loop. When the last free hanging loop 62 is fully payed out, the springs will act to support one half the weight of the adjacent, upstream free hanging loop 74 and also counteract the acceleration force (approximately 260 lbs.) of the adjacent, upstream free hanging loop 74 when it accelerates rapidly and jerks as it begins to be payed out. In the preferred embodiment, the total amount of force exerted by the springs 68 when fully extended is approximately 300 lbs. Ideally, the shock roll 64 should be as lightweight as possible so as to not contribute to additional spring force requirements. However, it should be appreciated that the invention is not limited by the amount of force exerted by the springs 68 and that the amount of force would vary depending on the size and weight of the asphalt-coated sheet 20 and the length of the last free hanging loop 62. The importance of the amount of force exerted by the springs 68 will be discussed below.

The shock absorber assembly 50 also includes one or more, and preferably at least three, and more preferably five guide wheels or rolls 70, located at the opposite or downstream end of the shock absorber assembly 50. It should be understood that the invention is not limited to the number of guide rolls 70, and that the invention can be practiced with any desirable number of rolls. In the preferred embodiment, the guide rolls 60 are approximately six inches in diameter. The guide rolls 70 engage the asphalt-coated sheet 20 to guide it flat across the top of the empty looper rolls 34 downstream of the shock absorber assembly 50. The guide rolls 70 are attached to the frame structure 52 by means of a bracket 72 on each side of the frame structure 52 (only one of which is shown in FIGS. 2 and 4). Preferably, the brackets 72 are attached to the frame structure 52 such that the guide rolls 70 remain substantially stationary with respect to the frame structure 52, unlike the pivot arms 56 and 66 that allow pivoting movement of the brake and shock rolls 54 and 64, respectively.

Figure 3:
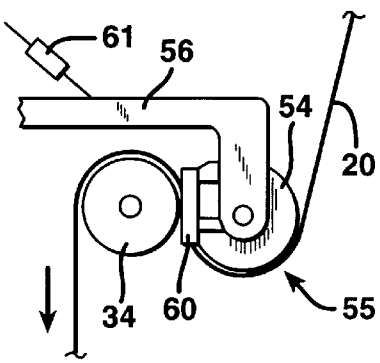
FIG. 3 is a side elevational view of the shock absorber assembly showing the sheet engaging the indexing roll of the shock absorber assembly.

The operation of the shock absorber assembly 50 for reducing breaks in the asphalt-coated sheet 20 will now be described. As shown in FIG. 2, the asphalt-coated sheet 20 is hung over the looper roll 34 to form a last free hanging loop 62. An adjacent, upstream free hanging loop 74 is also freely hanging over an adjacent looper roll 34. As shown in FIGS. 2 and 3, the indexing roll 54 is a down position and the shock roll 64 is in an up position.

As the last free hanging loop 62 is payed out, the downstream portion of the last loop moves rapidly upwards at a speed usually exceeding about 300 ft/min. When the loop 62 is completely payed out, as indicated by the dotted line in FIG. 2, the asphalt-coated sheet 20 of the loop 62 engages the indexing roll 54, as indicated by the dotted line in FIG. 2, and as shown in FIG. 3. Typically, the length of time for a full hanging loop having a length of about twenty-five feet to move upward until it engages the indexing roll 54 is approximately 2.5 seconds.

When the last free hanging loop 62 engages the indexing rolls 54, the indexing rolls 54 pivot about the pivot axis 58 from the down position, as shown in FIGS. 2 and 3, to the up position, as shown in FIG. 4. Typically, the length of time for the indexing roll 54 to move from the down position to the up position is less than about one-tenth of a second. When in the up position, the brake pad 60 will no longer frictionally engage the asphalt-coated sheet 20. As this point, the acceleration of the adjacent, upstream free hanging loop 74 of the asphalt-coated sheet 20 up to payout speed will cause the shock roll 64 to move from the up position, as shown in FIGS. 2 and 3, to the down position, as indicated by the dotted lines in FIG. 4. Typically, the length of time for the shock roll 64 to move from the up position to the down position is approximately one-tenth of a second. As a result of the movement of the shock roll 64 from the up position to the down position, the path length of the asphalt-coated sheet 20 in the finish looper 32 is decreased in the range between about one to two feet. This decrease in path length enables the shock roll 64 to absorb the shock due to the jerk produced when the last free hanging loop 62 is payed out, thereby reducing breakage of the asphalt-coated sheet 20.

While the indexing roll 54 is in the up position and the shock roll 64 is in the down position, the biasing force of the counterweight 59 causes the frame structure 52 to travel in the upstream direction. As the frame structure 52 travels upstream, the indexing roll 54 moves from the up position, as shown in FIG. 4, to the down position, as shown in FIGS. 2 and 3. Typically, the length of time for the indexing roll 54 to move from the up position to the down position is approximately 0.5 second. The frame structure 52 will travel downstream until the brake pad 60 engages the asphalt-coated sheet 20 of the adjacent, upstream looper roll 34. In this manner, the indexing rolls 54 provide an indexing function to position the shock absorber assembly 50 at the adjacent, upstream free hanging loop 74.

As the weight of the last free hanging loop 62 is payed out, its weight decreases. As a result of the upward force exerted by the springs 68 and the decreasing weight of the last free hanging loop 62, the shock roll 64 will gradually move from the down position, as shown in FIG. 4, to the up position, as shown in FIG. 2. Typically, the length of time for the shock roll 64 to move from the down position to the up position is two to three seconds. The above cycle is then repeated for the adjacent, upstream free hanging loop 74.

It should be appreciated that the path length of the asphalt-coated sheet 20 through the shock absorber assembly 50 can be shortened in a variety of different ways. In an alternative embodiment, the shock roll 64 may be stationary with respect to the frame structure 52 and the guide rolls 70 may be mounted to the frame structure is 52 to allow the guide rolls 70 to move transversely upstream and downstream to shorten the path length of the asphalt-coated sheet 20 through the shock absorber assembly 50.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A shock absorber assembly for a finish looper having a plurality of looper rolls forming a plurality of free hanging loops of an asphalt-coated sheet, said shock absorber assembly comprising:

a shock roll for supporting a last free hanging loop of said plurality of free hanging loops, wherein said shock roll is capable of being positioned relative to an adjacent, upstream looper roll and its associated free hanging loop when the last free hanging loop is payed out.

2. The shock absorber assembly according to claim 1, wherein said shock absorber assembly further includes an indexing roll and a guide roll, said shock roll being positioned between said indexing roll and said guide roll.

3. The shock absorber assembly according to claim 2, wherein said indexing roll is capable of movement relative to said plurality of looper rolls when the asphalt-coated sheet is payed out from the last loop of said plurality of free hanging loops, and wherein said guide roll remains substantially stationary when the asphalt-coated sheet is payed out from the last free hanging loop of said plurality of free hanging loops.

4. The shock absorber assembly according to claim 3, wherein the movement of one of said indexing roll and said shock roll shortens a path length of the asphalt-coated sheet through said finish looper.

5. The shock absorber assembly according to claim 1, further including a frame structure capable of relative movement with respect to said plurality of looper rolls.

6. The shock absorber assembly according to claim 5, further including a pivot arm pivotally mounted to said frame structure for allowing pivoting movement of said shock roll.

7. A shock absorber assembly for a finish looper having a plurality of looper rolls for forming a plurality of free hanging loops of the asphalt-coated sheet, said shock absorber assembly comprising:

an indexing roll having a brake pad positioned adjacent a last free hanging loop of said plurality of free hanging loops, wherein said indexing roll prevents the free hanging loop from traveling in a downstream direction as the asphalt-coated sheet is being payed out from the last free hanging loop.

8. The shock absorber assembly according to claim 7, wherein said shock absorber assembly further includes a shock roll and a guide roll, said shock roll being positioned between said indexing roll and said guide roll.

9. The shock absorber assembly according to claim 8, wherein the brake pad and shock rolls are capable of movement relative to said plurality of looper rolls when the asphalt-coated sheet is payed out from the last loop of said plurality of free hanging loops, and wherein said guide roll remains substantially stationary when the asphalt-coated sheet is payed out from the last free hanging loop of said plurality of free hanging loops.

10. The shock absorber assembly according to claim 9, wherein the movement of one of said indexing roll and said shock roll shortens a path length of the asphalt-coated sheet through said finish looper, thereby reducing breakage of the asphalt-coated sheet.

11. A shock absorber assembly for a finish looper having a plurality of looper rolls for forming a plurality of free hanging loops of the asphalt-coated sheet, said shock absorber assembly comprising:

an indexing roll having a brake pad positioned adjacent a looper roll forming a last free hanging loop of said plurality of free hanging loops, wherein said indexing roll provides an indexing function for said shock absorber assembly by positioning said shock absorber assembly relative to an adjacent, upstream looper roll and its associated free hanging loop when the last free hanging loop is payed out.

12. The shock absorber assembly according to claim 11, wherein said shock absorber assembly further includes a shock roll and a guide roll, said shock roll being positioned between said indexing roll and said guide roll.

13. The shock absorber assembly according to claim 11, wherein said brake and shock rolls are capable of movement relative to said plurality of looper rolls when the asphalt-coated sheet is payed out from the last loop of said plurality of free hanging loops.

14. The shock absorber assembly according to claim 13, wherein the movement of one of said indexing roll and said shock roll shortens a path length of the asphalt-coated sheet through said finish looper, thereby reducing breakage of the asphalt-coated sheet.

15. A method of reducing breaks in a asphalt-coated sheet in a finish looper having a plurality of looper rolls for forming a plurality of free hanging loops of the asphalt-coated sheet, the method comprising providing a shock absorber assembly having a shock roll for supporting a last free hanging loop of the plurality of free hanging loops, whereby the shock roll is capable of being positioned relative to an adjacent, upstream looper roll and its associated free hanging loop when the last free hanging loop is payed out.

16. The method according to claim 15, further comprising the step of positioning the shock absorber assembly adjacent an upstream looper roll and its associated free hanging loop when the asphalt-coated sheet is payed out from the last loop of said plurality of free hanging loops.

17. The method according to claim 15, wherein the path length is shortened by moving at least one roll of the shock absorber assembly when the asphalt-coated sheet is payed out from the last loop of said plurality of free hanging loops.

18. The method according to claim 17, further comprising the step of positioning the shock absorber assembly adjacent an upstream looper roll and its associated free hanging loop when the asphalt-coated sheet is payed out from the last loop of said plurality of free hanging loops.

19. The method according to claim 15, wherein the path length is shortened by moving at least two rolls of the shock absorber assembly when the asphalt-coated sheet is payed out from the last loop of said plurality of free hanging loops.

20. The method according to claim 19, further comprising the step of positioning the shock absorber assembly adjacent an upstream looper roll and its associated free hanging loop when the asphalt-coated sheet is payed out from the last loop of said plurality of free hanging loops.

* * * * *